US006243996B1

(12) United States Patent
Oliver et al.

(10) Patent No.: US 6,243,996 B1
(45) Date of Patent: Jun. 12, 2001

(54) ADJUSTABLE TRUSS FOR MATING SEAM OF MULTI-SECTION MANUFACTURED HOME

(76) Inventors: James Oliver; Evon L. Oliver, both of P.O. Box 58, Hohenwald, TN (US) 38462

( * ) Notice: Subject to any disclaimer, the term of this patent is extended or adjusted under 35 U.S.C. 154(b) by 0 days.

(21) Appl. No.: 09/320,744

(22) Filed: May 27, 1999

Related U.S. Application Data

(60) Division of application No. 09/186,102, filed on Nov. 5, 1998, and a continuation-in-part of application No. 09/262,278, filed on Mar. 4, 1999.

(51) Int. Cl.[7] ..... B66F 3/08; E02D 27/48; E04G 25/06

(52) U.S. Cl. ..... 52/126.1; 52/126.7; 52/127.2; 52/143; 52/299; 52/693; 52/DIG. 11; 248/200.1; 248/354.1; 248/354.3; 254/100

(58) Field of Search ..... 52/126.1, 126.5, 52/126.7, 127.2, 291, 299, 143, 149, 657, 693, 695, DIG. 11; 248/354.1, 354.3, 357, 200.1; 254/98, 100, 101, 133 A

(56) References Cited

U.S. PATENT DOCUMENTS

| | | | | |
|---|---|---|---|---|
| D. 340,790 | | 10/1993 | Goodrich et al. . | |
| 2,914,816 | * | 12/1959 | Lundgren | 52/695 X |
| 3,316,680 | | 5/1967 | Chrastek . | |
| 3,362,117 | * | 1/1968 | Van Raden | 52/291 X |
| 3,430,911 | * | 3/1969 | Olson | 254/100 |
| 3,868,802 | | 3/1975 | Schubach . | |
| 4,417,426 | | 11/1983 | Meng . | |
| 4,468,150 | * | 8/1984 | Price | 248/354.3 X |
| 4,862,654 | | 9/1989 | Macias . | |
| 4,866,797 | | 9/1989 | Vollan . | |
| 4,880,203 | * | 11/1989 | Holcomb et al. | 254/98 X |
| 4,937,989 | | 7/1990 | Miyares et al. . | |
| 5,277,405 | * | 1/1994 | McSwain | 254/98 |
| 5,301,480 | | 4/1994 | Oyama et al. . | |
| 5,359,821 | | 11/1994 | Merriman . | |
| 5,398,466 | | 3/1995 | Oyama et al. . | |
| 5,501,754 | | 3/1996 | Hiraguri . | |
| 5,509,237 | | 4/1996 | Coulter . | |
| 5,640,814 | | 6/1997 | Godfrey . | |
| 5,761,855 | | 6/1998 | Uang . | |
| 5,893,253 | * | 4/1999 | Lutz, III | 52/695 |

* cited by examiner

*Primary Examiner*—Laura A. Callo
(74) *Attorney, Agent, or Firm*—Calif Tervo

(57) ABSTRACT

An adjustable truss (10) for a multi-section manufactured home (70) comprising a left section (71L) and a right section (71R); each section having a beam (72) having a lower end (75) including an inner flange (77) and an outer flange (78) and a upper end (73) supporting a transverse floor joist (80) having an end (84) at a mating seam (95). In a preferred embodiment, truss (10) comprises: a joist connector (30) is disposed under mating seam (95); jacks (20L, 20R) of adjustable length spanning respectively between the lower ends (75L, 75R) of beam (72l, 72R) and joist connector (30); a tie bar assembly (50) including an elongate bar (51) attached to beam lower ends (75); and a center jack (60) of adjustable length spanning between tie bar (51) and mating seam (95).

28 Claims, 1 Drawing Sheet

ADJUSTABLE TRUSS FOR MATING SEAM OF MULTI-SECTION MANUFACTURED HOME

CROSS REFERENCE TO RELATED APPLICATION

This application is a continuation-in-part of co-pending application Ser. No. 09/186,102 filed Nov. 5, 1998 titled Adjustable Outrigger for Manufactured Home, now pending, and co-pending application Ser. No. 09/262,278 filed Mar. 4, 1999 titled Push/pull Outrigger for Manufactured Home, now pending.

BACKGROUND OF THE INVENTION

1. Field of the Invention

This invention relates to a support for the marriage or mating seam of a multi-section manufactured home, mobile home, or trailer coach, and more specifically to an adjustable truss for application in situ for supporting the mating seam.

2. Description of the Related Art

The maximum width of a manufactured home is typically restricted to the maximum width allowable for common transport on public highways. Consequently, two or more manufactured home sections often are transported separately and then joined to form a wider, larger manufactured home. A larger manufactured home may be called a "multi-section", or a "double-wide" or a "triple-wide", as appropriate.

The floor juncture of the two sections is called a mating seam or a marriage seam. Conventionally, the floors adjacent the mating seam are only directly supported by the cantilevered ends of traverse floor joists, such that the seam is wavy and/or floors on either side of the seam do not align to form a flat surface. Of course, such results are undesirable.

A section for a multi-section manufactured home typically includes one or more longitudinal main I-beams which support a plurality of transverse floor joists which directly support the floor and the wall structure including wall studs. A plurality of spaced support piers support the main beams.

Conventionally, the mating seam has been supported, if at all, by vertical perimeter jacks disposed between the ground and the outer end of the joists. Conventional perimeter jacks have several disadvantages. For example, it is common for the support piers to settle and to settle by differing amounts such that the load on a particular perimeter pier will increase to unacceptable levels, even to failure level. Also, support piers need frequent adjustment to even the loading on the main beams. Each such adjustment requires that the perimeter jacks be adjusted also.

Therefore, there has been a need for means for supporting the mating seam of a manufactured home that overcomes the shortcomings of the prior art.

Preferably, the support means is easily applied in situ in the field.

SUMMARY OF THE INVENTION

The invention is a truss for a multi-section manufactured home comprising a left section and a right section; each section having a beam having an upper end and a lower end; the upper end of each beam supporting a transverse floor joist having an end at a mating seam distal from each beam.

The truss generally comprises a left jack of adjustable length spanning between the lower end of the left beam and the end of the left joist, a right jack of adjustable length spanning between the lower end of the right beam and the end of the right joist, a tie bar assembly including an elongate bar attached to the lower ends of the beams, and a center jack of adjustable length spanning between the tie bar and the mating seam. Preferably, the tie bar assembly includes means for adjusting the length of the bar between the beams so as to change the tension in the bar.

In one embodiment, the tie bar is attached to the beams without any alteration of the beams by attachment of a hook to the beam outer flange.

Preferably, a joist connector is disposed under the ends of left and right joists, and the left and right jacks span between the beams and the joist connector.

Other features and many attendant advantages of the invention will become more apparent upon a reading of the following detailed description together with the drawings in which like reference numerals refer to like parts throughout.

DETAILED DESCRIPTION OF THE INVENTION

Figure 1:
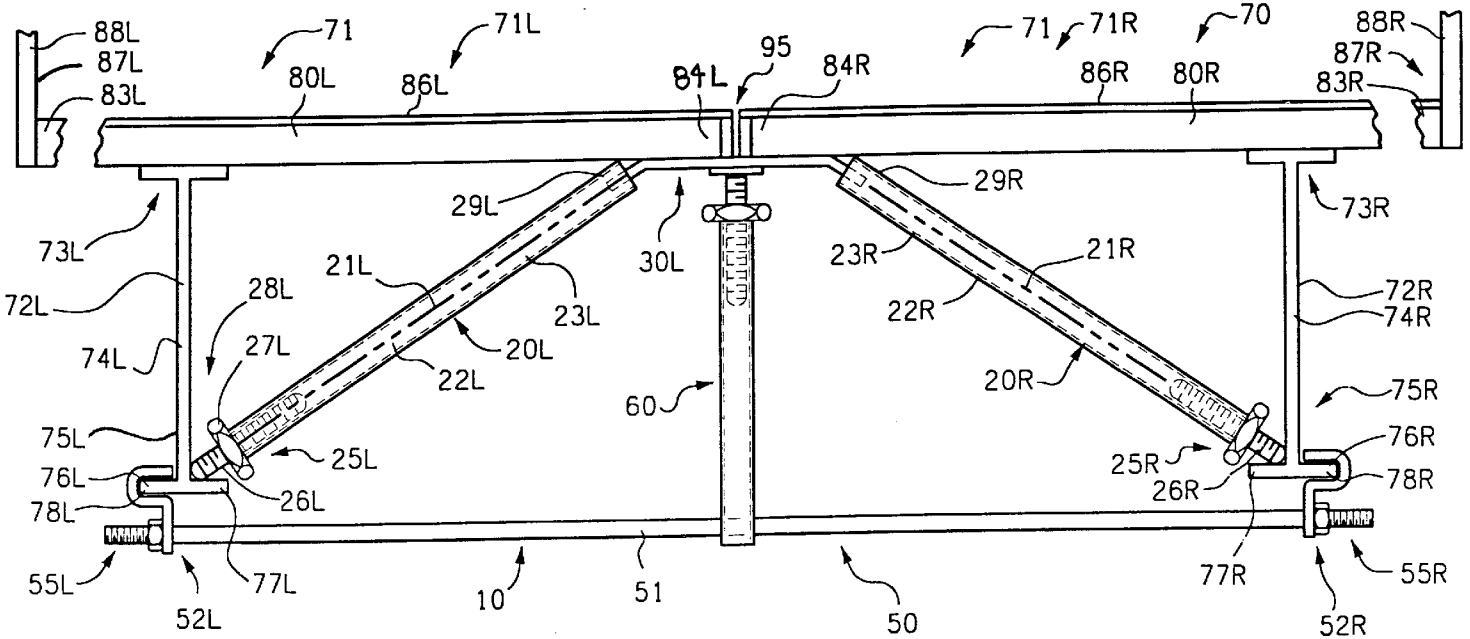
FIG. 1 is a fragmentary front sectional view of a pair of mated manufactured homes showing the adjustable truss of the invention.

With reference now to drawings, FIG. 1 is a fragmentary front sectional view of a pair of sections 71, such as left section 71L and right section 71R, adjoining at marriage or mating seam 95 to form a multi-section manufactured home 70 and showing the adjustable truss 10 of the invention. Truss 10 generally comprises left jack 20L, right jack 20R, tie bar assembly 50, and center jack 60. Because the structural elements of each section 71L,71R are similar or identical, for brevity, only the left section 71L will be described with its elements designated with an "L" suffix; the corresponding elements of the right section 71R being designated by the same numeral but having an "R" suffix.

The structural elements of section 71L typically include a plurality, typically a pair, of large main beams, such as I-beam 72L running the length of section 71L, supporting a plurality of to floor joists, typically transverse joists, such as joist 80L.

I-beam 72L is typically supported at a plurality of locations along its length by support piers, not shown, of adjustable height. Each support pier is supported by the ground or a foundation.

I-beam 72L has an upper end 73L, a vertical web 74L and a lower end 75L including a flange, such as T-flange 76L, including a inner flange 77L and an outer flange 78L. Upper end 73L supports floor joist 80L at a distance from its outer end 83L.

Floor joist 80L supports everything above it including floor 86L and walls, including outer wall 87L. Outer end 83L of joist 80L supports outer wall 87L of home 70 including a plurality of wall studs, such as stud 88L. Inner end 84L of joist 80L is cantilevered and terminates distal from beam 72L at mating seam 95.

Jack 20L of adjustable length has a longitudinal axis 21L and spans between lower end 75L of left beam 72L and end 84L of joist 80L for supporting end 84L. Jack 20L includes an elongate central portion 22L including a lower end 28L and an upper end 29L. Lower end 28L is adapted by any suitable means to be supported by lower end 75L of beam 72L. In the preferred embodiment, lower end 28L is simply supported at the intersection of flange 77L and web 74L such that jack 20L can exert a longitudinal force on beam 72L. Preferably, lower end 28L is adapted to pivot so as to support jack 20L over a range of slant angles. Jack upper end 29L is connected to end 84L of joist 80L by any suitable means, such as those shown in the cross-references patents, for exerting a longitudinal force on joist 80L.

A majority of the length of jack 20L comprises a strong rigid member, such as metal pipe 23L. Length adjustment means 25L adjusts the length of jack 20L so as to exert a longitudinal force on beam 72L and inner end 84L of joist 80L for supporting inner end 84L. Length adjustment means 25L includes threaded rod 26L and adjustment nut 27L. Threaded rod 26L has in inner end disposed in pipe 23L. Length is adjusted by turning rod 26L relative to nut 27L. The specific length adjustment means illustrated and described is only one of many possible and contemplated means.

Figure 2:
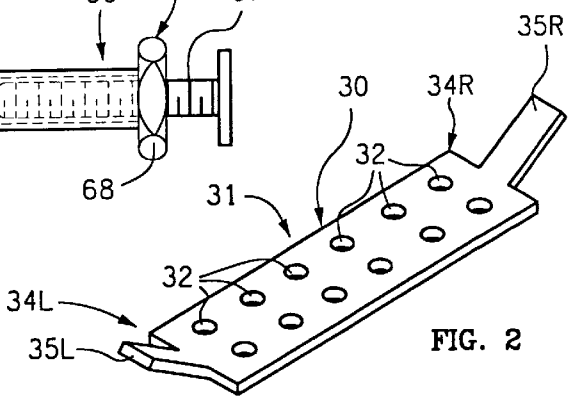
FIG. 2 is an enlarged perspective view of the joist connector of FIG. 1

Looking also at FIG. 2, there is shown an enlarged perspective view of a preferred embodiment of joist connector 30 of FIG. 1 connecting jack upper end 29L to end 84L of joist 80L for exerting a longitudinal jack force with an upward component force on joist 80L. Thrust block or joist connector 30 includes a central portion 31, including means, such as bores 32 for receiving fasteners, such as screws, nails, carriage bolts or the like, not shown, for fastening joist connector 30 to the underside of inner ends 84L, 85R of joists 80L, 80R so as to span mating seam 95. Joist connecter 30 can be used to hold left or right jack 20L, 20R in position while positioning the other jack. Once joist connector 30 is in position, it can be seen that it is primarily or solely held in position by jacks 20L, 20R. The only sheer forces through the fasteners attaching it to joists 80L, 80R is from the difference in the inward horizontal forces resulting from the longitudinal forces from jacks 20L, 20R. Thus, jacks 20L, 20R can exert large longitudinal forces having an upward component on mating seam 95 without any direct attachment to joists 80L, 80R.

Each end 34L, 34R of joist connecter 30 includes mating connection means, such as downward sloping tongues 35L, 35R for insertion into upper ends 29L, 29R of pipe 23L, 23R, for mating attachment of jacks 20L, 20R such that jacks 20L, 20R may exert a longitudinal force on joists 80L, 80R. Joist connector 30 is made preferably of strong material, such as iron or steel.

Figure 3:
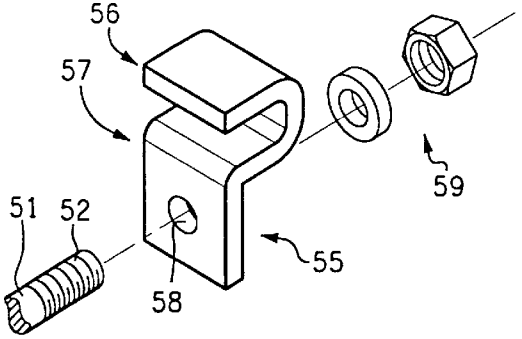
FIG. 3 is an enlarged perspective view of a tie bar bracket.

FIG. 3 is an enlarged perspective view of a tie bar bracket 55. As seen in FIGS. 1 and 3, tie bar assembly 50 generally includes an elongate bar 51 spanning between lower ends 75L, 75R of beams 72L, 72R, means, such as a pair of brackets 55, such as left bracket 55L and right bracket 55R, for attaching the ends 52 of bar 51 to beams 72L, 72R, and means for adjusting the tension in bar 51. Bar 51 is made of material having strong tensile strength, such as of steel bar or cable. Left bracket 55L connects left end 52L of bar 51 to lower end 75L of left beam 72L, and right bracket 55R connects right end 52R of bar 51 to lower end 75R of right beam 72R. Preferably, ends 52 of bar 51 are attached to beams 72L, 72R in a manner that does not require any modification to beams 72L, 72R. Each bracket 55 includes a hook portion 56 for laying atop outer flange 78L, 78R and a descending portion 57 disposed below beam 72L, 72R including means, such as bore 58, for attachment of end 52 of bar 51. In the preferred embodiment shown, ends 52 of bar 51 are threaded, are disposed through bores 58 of left and right brackets 55L, 55R and are fastened by fastening means 59, such as washer and nut. Fastening means 59 also serves as means for adjusting the tension in rod 51. Other bar 51 fastening and adjusting means are contemplated. For example, ends 52 of bar 51 may be adapted to directly attach to lower end of beam 72 and a turn buckle or similar devise may be used to adjust the tension in bar 51. Tie bar assembly 50 aids in holding home sections 70L, 70K together, prevents lower ends 75L, 75R of beams 72L, 72R from spreading from the force of jacks 20L, 20R, supports center jack 60.

Figure 4:
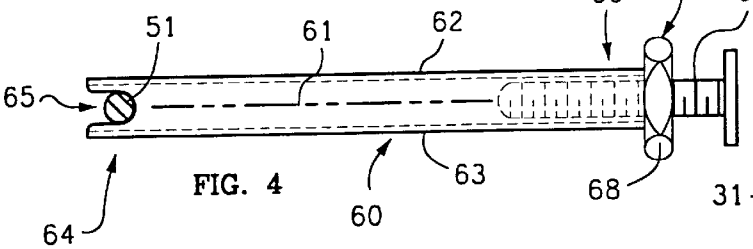
(FIG. 4 is side view of the center jack of FIG. 1.

Looking now also at FIG. 4 there is shown a side view of the center jack 60 of FIG. 1. Center jack 60 of adjustable length has a vertical longitudinal axis 61 and spans between bar 51 and mating seam 95 or central portion 31 of joist connector 30 for supporting left and right ends 84L, 84R of joists 80L, 80R at mating seam 95. Jack 60 includes an elongate central portion 62 including a lower end 64 and an upper end 69. Lower end 64 is adapted by any suitable means to be supported by rod 51. In the preferred embodiment, lower end 64 simply includes a receiving slot 65 for receiving bar 51. A majority of the length of jack 60 comprises a strong rigid member, such as metal pipe 63. Length adjustment means 66 adjusts the length of jack 60 so as to exert a longitudinal supporting force on mating seam 95. Length adjustment means 66 includes threaded rod 67 and adjustment nut 68. Threaded rod 67 has in inner end disposed in pipe 63. Length is adjusted by turning rod 67 relative to nut 68. The specific length adjustment means illustrated and described is only one of many possible and contemplated means. Preferably, truss 10 is disposed in substantially a vertical plane.

Having described the invention, it can be seen that truss 10 provides a very desirable device for supporting the mating seam 95 of a multi-section manufactured home. Importantly, truss 10 of the invention is easily applied in situ and requires only a wrench and a hammer or screw driver. No drilling, cutting or other fabrication is required.

Although a particular embodiment of the invention has been illustrated and described, various changes may be made in the form, composition, construction, and arrangement of the parts without sacrificing any of its advantages. Therefore, it is to be understood that all matter herein is to be interpreted as illustrative and not in any limiting sense, and it is intended to cover in the appended claims such modifications as come within the true spirit and scope of the invention.

We claim:

1. A truss for a multi-section manufactured home; the home comprising a left section and a right section; each section having a beam having an upper end and a lower end; the upper end of each beam supporting an associated floor joist that is transverse to the beam; each joist having an end; the joist ends being adjacent distal from each beam; said truss comprising:

a left jack of adjustable length having a longitudinal axis; said left jack adapted for spanning between the lower end of the left beam and the end of the left joist for supporting the end of the left joist; said left jack including:

an elongate central portion including:

a lower end adapted for being supported by the lower end of the left beam such that said left jack can exert a longitudinal force on the left beam;

an upper end adapted for connection to the end of the left joist such that said left jack can exert an upward force on the joist; and length adjustment means for adjusting the length of said central portion of said left jack;

a right jack of adjustable length having a longitudinal axis; said right lack adapted for spanning between the lower end of the right beam and the end of the right joist for supporting the end of the right joist; said right jack including:

an elongate central portion including:

a lower end adapted for being supported by the lower end of the right beam such that said right jack can exert a longitudinal force on the right beam;

an upper end adapted for connection to the end of the right joist such that said right jack can exert an upward force on the right joist; and length adjustment means for adjusting the length of said central portion of said right jack;

a tie bar assembly including:

an elongate bar having:

a left end; and a right end; and attachment means for attaching said bar ends to the lower ends of the beams; and a center lack of adjustable length having a longitudinal axis; said center lack for spanning between said bar and the joist ends; said center jack including:

an elongate central portion including:

a lower end adapted to be supported by said bar;

an upper end adapted for supporting the joist ends; and length adjustment means for adjusting the length of said central portion of said center jack for exerting, by said center lack, a downward force on said bar and upward force on the joist ends.

2. The truss of claim 1 wherein:

said tie bar assembly includes:

means for adjusting the length of said bar between said beams so as to change the tension in said bar.

3. The truss of claim 1 wherein:

said tie bar attachment means requires no alteration of the beams.

4. A truss for a multi-section manufactured home; the home comprising a left section and a right section; each section having a beam having an upper end and a lower end; each lower end including an inner flange and an outer flange; each upper end supporting an associated floor joist that is transverse to the beam; each joist having an end; the joist ends being adjacent distal from each beam; said truss comprising:

a left jack of adjustable length having a longitudinal axis; said left jack adapted for spanning between the lower end of the left beam and the end of the left joist for supporting the end of the left joist; said left jack including:

an elongate central portion including:

a lower end adapted for being supported by the inner flange of the left beam such that said left jack can exert a longitudinal force on the left beam;

an upper end adapted for exerting an upward force on the end of the left joist; and length adjustment means for adjusting the length of said central portion of said left jack;

a right jack of adjustable length having a longitudinal axis and spanning between the lower end of the right beam and the end of the right joist for supporting the end of the right joist; said right jack including:

an elongate central portion including:

a lower end adapted for being supported by the inner flange of the right beam such that said right jack can exert a longitudinal force on the right beam;

an upper end adapted for exerting an upward force on the end of the right joist; and length adjustment means for adjusting the length of said central portion of said right jack;

a tie bar assembly including:

an elongate bar having:

a left end; and a right end; and attachment means for attaching said bar ends to the outer flanges of the lower ends of the beams; and a center jack of adjustable length having a longitudinal axis; said center jack for spanning between said bar and the joist ends; said center jack including:

an elongate central portion including:

a lower end adapted to be supported by said bar;

an upper end adapted for supporting the joist ends; and length adjustment means for adjusting the length of said central portion of said center jack for exerting, by said center jack, a downward force on said bar and upward force on the joist ends.

5. The truss of claim 4 wherein:

said tie bar assembly includes:

means for adjusting the length of said bar between said beams so as to change the tension in said bar.

6. The truss of claim 4 wherein:

said tie bar attachment means requires no alteration of the beams.

7. The truss of claim 4 wherein said tie bar attachment includes:

a pair of brackets; each bracket including:

a hook portion for hooking over a beam outer flange.

8. A truss for a multi-section manufactured home; the home comprising a left section and a right section; each section having a beam having an upper end and a lower end; each lower end including an inner flange and an outer flange; each upper end of each beam supporting an associated floor joist that is transverse to the beam; each joist having an end; the joist ends being adjacent distal from each beam; said truss comprising:

a joist connector for disposition under the joist ends for supporting the joist ends including:

a left end; and a right end;

a left jack of adjustable length having a longitudinal axis; said left jack adapted for spanning between the lower end of the left beam and the left end of the joist connector for supporting the end of the left joist; said left jack including:

an elongate central portion including:

a lower end adapted for being supported by the lower end of the left beam such that said left jack can exert a longitudinal force on the left beam;

an upper end adapted attachment to said left end of said joist connector for exerting an upward force on said joist connector; and length adjustment means for adjusting the length of said central portion of said left jack;

a right jack of adjustable length having a longitudinal axis and spanning between the lower end of the right beam and the right end of said joist connector for supporting the end of the right joist; said right jack including:

an elongate central portion including:

a lower end adapted for being supported by the lower end of the right beam such that said right jack can exert a longitudinal force on the right beam;

an upper end adapted for exerting an upward force on said joist connector; and length adjustment means for adjusting the length of said central portion of said right jack;

a tie bar assembly including:

an elongate bar having:

a left end; and a right end; and attachment means for attaching said bar ends to the outer flanges of the lower ends of the beams; and a center jack of adjustable length having a longitudinal axis; said center jack for spanning between said bar and the joist connector; said center jack including:

an elongate central portion including:

a lower end adapted to be supported by said bar;

an upper end adapted for supporting the joist connector; and length adjustment means for adjusting the length of said central portion of said center jack for exerting, by said center jack, a downward force on said bar and upward force on said joist connector.

9. The truss of claim 8 wherein:

said tie bar attachment means requires no alteration of the beams.

10. The truss of claim 8 wherein:

said left jack lower end is adapted for being upwardly supported by the left beam inner flange; and said right jack lower end is adapted for being upwardly supported by the right beam inner flange.

11. A truss for a multi-section manufactured home; the home comprising a left section and a right section; each section having a beam having an upper end and a lower end; each lower end including an inner flange and an outer flange; each upper end of each beam supporting an associated floor joist that is transverse to the beam; each joist having an end; the joist ends being adjacent distal from each beam; said truss comprising:

a joist connector disposed under the joist ends for supporting the joist ends including:

a left end; and a right end;

a left jack of adjustable length having a longitudinal axis; said left jack adapted for spanning between the lower end of the left beam and the left end of the joist connector for supporting the end of the left joist; said left jack including:

an elongate central portion including:

a lower end adapted for being supported by the lower end of the left beam such that said left jack can exert a longitudinal force on the left beam;

an upper end adapted attachment to said left end of said joist connector for exerting an upward force on said joist connector; and length adjustment means for adjusting the length of said central portion of said left jack;

a right jack of adjustable length having a longitudinal axis and spanning between the lower end of the right beam and the right end of said joist connector for supporting the end of the right joist; said right jack including:

an elongate central portion including:

a lower end adapted for being supported by the lower end of the right beam such that said right jack can exert a longitudinal force on the right beam;

an upper end adapted for exerting an upward force on said joist connector; and length adjustment means for adjusting the length of said central portion of said right lack;

a tie bar assembly including:

an elongate bar having:

a left end; and a right end;

attachment means for attaching said bar ends to the outer flanges of the lower ends of the beams; and means for adjusting the length of said bar between said beams so as to change the tension in said bar.

12. The truss of claim 11 further including:

a center jack of adjustable length having a longitudinal axis for spanning between said bar and the joist ends; said center jack including:

an elongate central portion including:

a lower end adapted to be supported by said bar;

an upper end adapted for supporting the joist ends; and length adjustment means for adjusting the length of said central portion of said center jack for exerting, by said center jack, a downward force on said bar and an upward force on the joist ends.

13. The truss of claim 11 wherein:

said tie bar attachment means requires no alteration of the beams.

14. The truss of claim 11 wherein:

said left jack lower end is adapted for being upwardly supported by the left beam inner flange; and said right jack lower end is adapted for being upwardly supported by the right beam inner flange.

15. A truss for a multi-section manufactured home; the home comprising a left section and a right section; each section having a beam having an upper end and a lower end; each lower end including an inner flange and an outer flange; each upper end of each beam supporting an associated floor joist that is transverse to the beam; each joist having an end; the joist ends being adjacent distal from each beam; said truss comprising:

a joist connector disposed under the joist ends for supporting the joist ends including:

a left end; and a right end;

a left jack of adjustable length having a longitudinal axis; said left jack adapted for spanning between the lower end of the left beam and the left end of the joist connector for supporting the end of the left joist; said left lack including:

an elongate central portion including:

a lower end adapted for being supported by the lower end of the left beam such that said left jack can exert a longitudinal force on the left beam;

an upper end adapted attachment to said left end of said joist connector for exerting an upward force on said joist connector; and length adjustment means for adjusting the length of said central portion of said left jack;

a right jack of adjustable length having a longitudinal axis and spanning between the lower end of the right beam and the right end of said joist connector for supporting the end of the right joist; said right jack including:

an elongate central portion including:

a lower end adapted for being supported by the lower end of the right beam such that said right jack can exert a longitudinal force on the right beam;

an upper end adapted for exerting an upward force on said joist connector; and length adjustment means for adjusting the length of said central portion of said right jack;

a tie bar assembly including:

an elongate bar having:

a left end; and a right end; and attachment means for attaching said bar ends to the outer flanges of the lower ends of the beams; including:

a pair of brackets; each bracket including:

a hook portion for laying atop beam outer flange; and a descending portion connected to said hook portion and disposed below the beam.

16. The truss of claim 15 further including:

a center jack of adjustable length having a longitudinal axis for spanning between said bar and the joist ends; said center jack including:

an elongate central portion including:

a lower end adapted to be supported by said bar;

an upper end adapted for supporting the joist ends; and length adjustment means for adjusting the length of said central portion of said center jack for exerting, by said center jack, a downward force on said bar and an upward force on the joist ends.

17. The truss of claim 15 wherein:

said tie bar attachment means requires no alteration of the beams.

18. The truss of claim 15 wherein:

said left jack lower end is adapted for being upwardly supported by the left beam inner flange; and said right jack lower end is adapted for being upwardly supported by the right beam inner flange.

19. A truss for a multi-section manufactured home; the home comprising a left section and a right section; each section having a beam having an upper end and a lower end; each lower end including an inner flange and an outer flange; each upper end supporting an associated floor joist that is transverse to the beam; each joist having an end; the joist ends being adjacent distal from each beam; said truss comprising:

a left jack of adjustable length having a longitudinal axis; said left jack adapted for spanning between the lower end of the left beam and the end of the left joist for supporting the end of the left joist; said left jack including:

an elongate central portion including:

a lower end adapted for being supported by the lower end of the left beam such that said left jack can exert a longitudinal force on the left beam;

an upper end adapted for exerting an upward force on the end of the left joist; and length adjustment means for adjusting the length of said central portion of said left jack;

a right jack of adjustable length having a longitudinal axis and spanning between the lower end of the right beam and the end of the right joist for supporting the end of the right joist; said right jack including:

an elongate central portion including:

a lower end adapted for being supported by the lower end of the right beam such that said right jack can exert a longitudinal force on the right beam;

an upper end adapted for exerting an upward force on the end of the right joist; and length adjustment means for adjusting the length of said central portion of said right jack;

a tie bar assembly including:

an elongate bar having:

a left end; and a right end; and attachment means for attaching said bar ends to the outer flanges of the lower ends of the beams including:

a pair of brackets; each bracket including:

a hook portion for laying atop beam outer flange; and a descending portion connected to said hook portion and disposed below the beam.

20. In combination:

a multi-section manufactured home comprising:

a left section including:

a left beam including:

an upper end; and a lower end;

a left floor joist associated with and supported by said upper end of said left beam; said left floor joist being transverse to said left beam; said left floor joist including:

an end;

a right section including:

a right beam including:

an upper end; and a lower end;

a right floor joist associated with and supported by said upper end of said right beam; said right floor joist being transverse to said right beam; said right floor joist including:

an end; said ends of said floor joists being adjacent distal from each beam; and a truss comprising:

a left jack of adjustable length having a longitudinal axis and spanning between said lower end of said left beam and said end of said left joist and supporting said end of said left joist; said left jack including:

an elongate central portion including:

a lower end supported by said lower end of said left beam such that said left jack can exert a longitudinal force on said left beam;

an upper end connected to said end of said left joist such that said left jack can exert an upward force on said joist; and length adjustment means for adjusting the length of said central portion of said left jack;

a right jack of adjustable length having a longitudinal axis and spanning between said lower end of said right beam and said end of said right joist and supporting said end of said right joist; said right jack including:

an elongate central portion including:

a lower end supported by said lower end of said right beam such that said right jack can exert a longitudinal force on said right beam;

an upper end adapted for connection to said end of the right joist such that said right jack can exert an upward force on said right joist; and length adjustment means for adjusting the length of said central portion of said right jack; and a tie bar assembly including:

an elongate bar having:

a left end; and a right end; and attachment means for attaching said bar ends to said lower ends of the beams.

21. The combination of claim 20 wherein said truss further includes:

a center jack of adjustable length having a longitudinal axis and spanning between said bar and said joist ends; said center jack including:

an elongate central portion including:

a lower end supported by said bar;

an upper end supporting the joist ends; and length adjustment means for adjusting the length of said central portion of said center jack for exerting, by said center jack, a downward force on said bar and upward force on the joist ends.

22. The combination of claim 20 wherein said tie bar assembly includes:

means for adjusting the length of said bar between said beams so as to change the tension in said bar.

23. The combination of claim 20 wherein said tie bar attachment means requires no alteration of said beams.

24. In combination:

a multi-section manufactured home comprising:

a left section including:

a left beam including:

an upper end; and a lower end including:

an inner flange; and an outer flange;

a left floor joist associated with and supported by said upper end of said left beam; said left floor joist being transverse to said left beam; said left floor joist including:

an end;

a right section including:

a right beam including:

an upper end; and a lower end including:

an inner flange; and an outer flange;

a right floor joist associated with and supported by said upper end of said right beam; said right floor joist being transverse to said right beam; said right floor joist including:

an end; said ends of said floor joists being adjacent distal from each beam; and a truss comprising:

a left jack of adjustable length having a longitudinal axis and spanning between said lower end of said left beam and said end of said left joist and supporting said end of said left joist; said left jack including:

an elongate central portion including:

a lower end supported by said inner flange of said left beam such that said left jack can exert a longitudinal force on said left beam;

an upper end connected to said end of said left joist such that said left jack can exert an upward force on said joist; and length adjustment means for adjusting the length of said central portion of said left jack;

a right jack of adjustable length having a longitudinal axis and spanning between said lower end of said right beam and said end of said right joist and supporting said end of said right joist; said right jack including:

an elongate central portion including:

a lower end supported by said inner flange of said right beam such that said right jack can exert a longitudinal force on said right beam;

an upper end connected to said end of said right joist such that said right jack can exert an upward force on said joist; and length adjustment means for adjusting the length of said central portion of said right jack; and a tie bar assembly including:

an elongate bar having:

a left end; and a right end; and attachment means for attaching said bar ends to said outer flanges of said lower ends of said beams.

25. The combination of claim 24 wherein said truss further includes:

a center jack of adjustable length having a longitudinal axis and spanning between said bar and said joist ends; said center jack including:

an elongate central portion including:

a lower end supported by said bar;

an upper end supporting the joist ends; and length adjustment means for adjusting the length of said central portion of said center jack for exerting, by said center jack, a downward force on said bar and upward force on the joist ends.

26. The combination of claim 25 wherein said tie bar assembly includes:

means for adjusting the length of said bar between said beams so as to change the tension in said bar.

27. The combination of claim 25 wherein said tie bar attachment means requires no alteration of said beams.

28. The combination of claim 24 wherein said tie bar attachment includes:

a pair of brackets; each bracket including:

a hook portion for hooking over a beam outer flange.

* * * * *